US006940283B2

(12) United States Patent
McQueeney

(10) Patent No.: US 6,940,283 B2
(45) Date of Patent: Sep. 6, 2005

(54) DETECTING FIELD FROM DIFFERENT IGNITION COILS USING ADJUSTABLE PROBE

(75) Inventor: Kenneth A. McQueeney, Los Gatos, CA (US)

(73) Assignee: Snap-On Incorporated, Pleasant Prairie, WI (US)

( * ) Notice: Subject to any disclaimer, the term of this patent is extended or adjusted under 35 U.S.C. 154(b) by 147 days.

(21) Appl. No.: 10/391,633

(22) Filed: Mar. 20, 2003

(65) Prior Publication Data

US 2004/0183539 A1 Sep. 23, 2004

(51) Int. Cl.[7] ..... F02P 17/00
(52) U.S. Cl. ..... 324/380; 324/402
(58) Field of Search ..... 324/380, 318–402

(56) References Cited

U.S. PATENT DOCUMENTS 4,758,791 A * 7/1988 Tedeschi et al. ..... 324/402
5,004,984 A 4/1991 Becker et al.
5,444,376 A 8/1995 Dittmann et al.
5,461,316 A * 10/1995 Maruyama et al. ..... 324/402
6,359,439 B1 * 3/2002 Crecelius et al. ..... 324/391
6,396,277 B1 5/2002 Fong et al.

FOREIGN PATENT DOCUMENTS

| | | |
|---|---|---|
| DE | 8910945 | 10/1989 |
| EP | 0 716 227 A2 | 6/1996 |
| EP | 1 035 323 A2 | 9/2000 |
| WO | WO 03/012286 A1 | 2/2003 |

* cited by examiner

*Primary Examiner*—Anjan Deb
*Assistant Examiner*—Amy He
(74) *Attorney, Agent, or Firm*—McDermott Will & Emery LLP

(57) ABSTRACT

Detecting the magnetic field generated by a coil-on-plug (101) (aka coil-over-plug) using an adjustable probe (111). The probe (111) includes a signal detector (115) for detecting the field, a detachable adapter (117) configured to detachably attach to the housing (107) of the ignition coil at a specified location (113), and an adjustable connector (119 and 121) that adjustably connects the signal detector to the detachable adapter in a first predetermined position or in a second predetermined position. A detecting process and a diagnostic system using the probe are also disclosed.

19 Claims, 4 Drawing Sheets

FIG. 2(a)
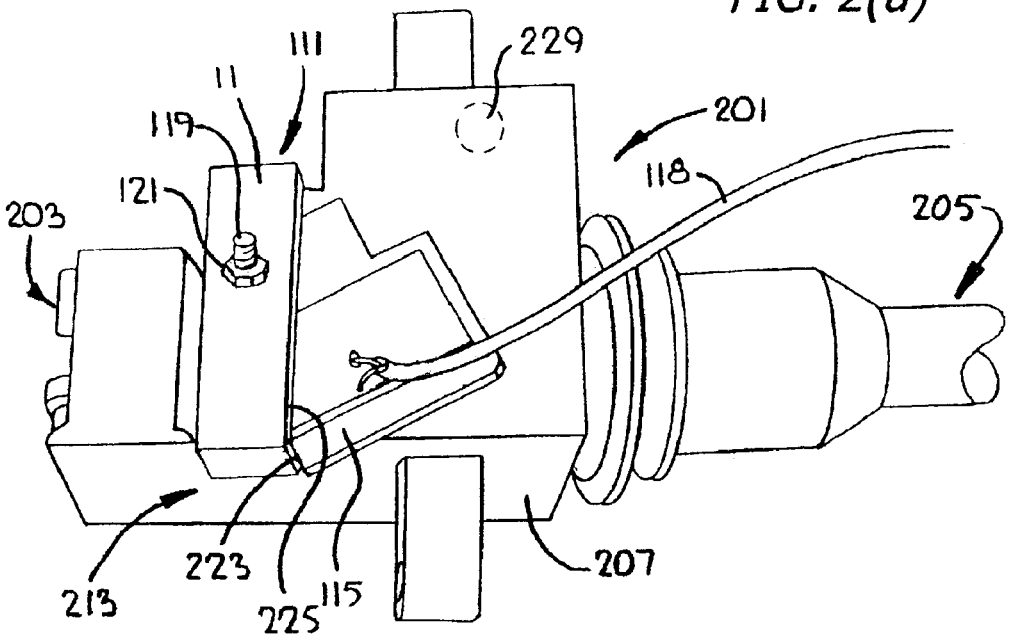
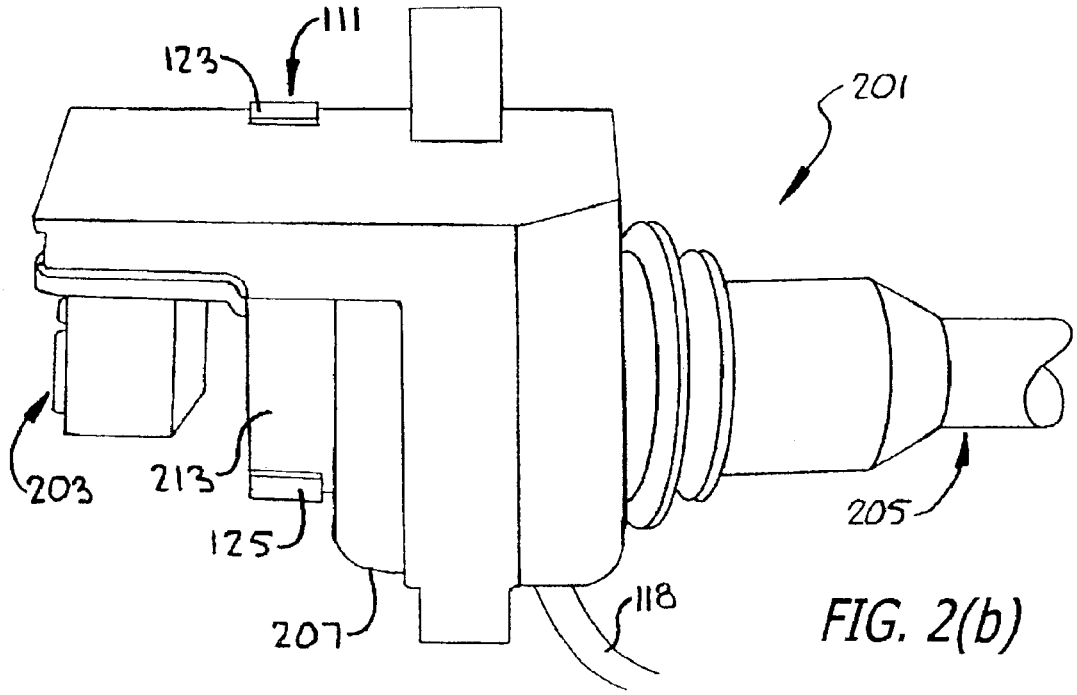
FIG. 2(b)

FIG. 6(a)
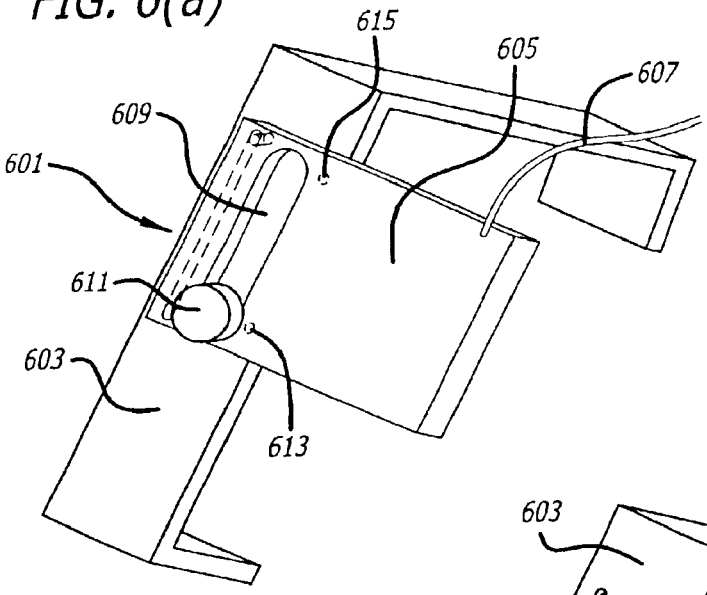
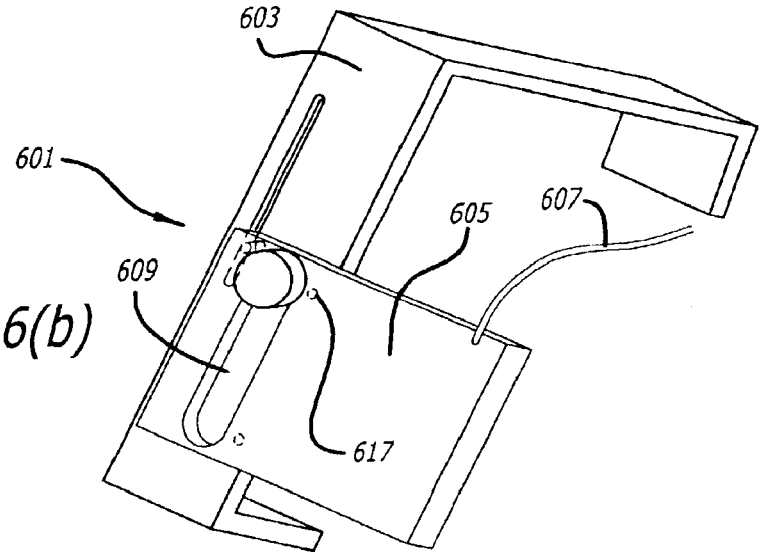
FIG. 6(b)
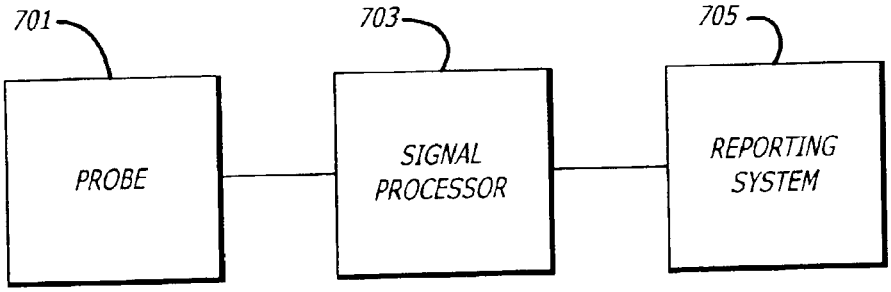
FIG. 7

DETECTING FIELD FROM DIFFERENT IGNITION COILS USING ADJUSTABLE PROBE

BACKGROUND

1. Field

This patent application is directed to the field of ignition coils. It is more specifically directed to measurement of the field that is emitted by ignition coils as a means of analyzing the signals that are delivered to spark plugs by the coils.

2. Description of Related Art

Ignition coils are commonly used to boost a low voltage supply voltage to the very high level that is necessary to ignite and sustain a spark. As is well known, the boosted voltage is usually delivered to a spark plug, typically installed in a combustion engine. The spark ignites fuel, causing increased pressure in the cylinder in which the spark plus is mounted and, in turn, movement of the engine.

In the past, a single ignition coil was used to supply the high voltage needed by several spark plugs. A distributor was connected between the ignition coil and the several spark plugs to sequentially distribute the high voltage that was created by the ignition coil to each of the spark plugs.

A new technology is often used today that is commonly referred to as "coil-on-plug" or "coil-over-plug" ("COP"). Each spark plug is provided with its own ignition coil positioned in close proximity to the spark plug.

As is well known, an analysis of the signal that is delivered to each spark plug can aid in the diagnosis of a problem with a combustion engine or, in the alternative, can confirm that the combustion engine is operating properly. When COP technology is used, however, the coil often blocks access to the spark plug wire. This creates a practical problem in detecting the needed signal.

One approach to overcoming this problem is to place a signal detector in close proximity to the ignition coil. The signal detector detects variations in the field that are caused by the ignition coil, typically by its secondary winding. This is typically accomplished by using a capacitive or inductive component in the signal detector. Examples of such signal detectors are described in U.S. Pat. No. 6,396,277 B1, the content of which is incorporated herein by reference.

A single signal detector is often used to detect the signals on several plugs. The process usually begins by the mechanic clipping the signal detector to the housing of a first ignition coil. The engine is then operated. The ignition coil generates a field each time the plug is fired. This voltage is typically proportional to the voltage that the coil delivers to the plug. The signal detector detects this field. The detected signal may then be processed to extract the most relevant information and the results are reported to the mechanic. The mechanic then typically detaches the detector from the first housing, attaches it to the housing of another ignition coil, and the process repeats, often until the voltages to all of the plugs have been studied.

Unfortunately, a single engine sometimes uses different models of COPs on its various cylinders. In V-6 engines, for example, some manufacturers use one COP model on the front cylinders, but a different COP model on the rear cylinders. These different COP models often generate fields of different intensity, even when they are delivering the same voltage to their respective spark plugs.

In some Nissan cars, for example, a Nissan model 22448-31 U01 COP is installed in the rear cylinders, while a Nissan model 22448-2Y000 COP is installed in the front cylinders. The 31U01, however, typically generates over twice the field strength that the 2Y000 generates when delivering the same output voltage.

This field strength differential often creates confusion during use, particularly with mechanics that are not aware of the differential. This confusion sometimes leads to the erroneous conclusion that a particular COP is not operating properly and, in turn, to unnecessary and unfruitful repairs.

Even when the mechanic is skilled enough not to be confused by the field strength differences, the field strength differential is sometimes greater than the dynamic range of the signal detector. This often requires different signal detectors to be stocked and used to fully test a single engine.

SUMMARY

This patent application is directed to a probe, detection process and diagnostic system for detecting the field emitted by one or more ignition coils.

The probe may include a signal detector for detecting the field, a detachable adapter configured to detachably attach to the housing of the ignition coil at a specified location, and an adjustable connector that adjustably connects the signal detector to the detachable adapter in a first pre-determined position or in a second pre-determined position.

The signal detector may include a conductive plate. The signal detector may also include two conductive plates. One plate may be connected to a ground wire, while the other plate may be connected to a signal wire. The two plates may be substantially parallel to but electrically insulated from one another. The plate that is connected to the signal wire may be located such that it lies between the plate that is connected to the ground wire and the ignition coil after the adapter is attached to the housing of the ignition coil.

The signal detector may include a coil.

The detachable adapter may include a clip. The clip may be configured to snap onto the housing.

The adjustable connector may include a pivot.

The adjustable connector may allow the signal detector to move laterally with respect to the detachable adapter when moving from the first to the second position.

The adjustable connector may include a first movement stop that causes the signal detector to releasably lock into the first position and a second movement stop that causes the signal detector to releasably lock into the second position. The first movement stop may include two surface areas that engage when the signal detector is releasably locked into the first position. Similarly, the second movement stop may include two surfaces areas that engage when the signal detector is releasably locked into the second position.

The probe may detect the field that is emitted by a first ignition coil in a housing and, at a different time, by a second ignition coil in a housing. The first and second ignition coils may emit fields of different magnitude during the delivery of substantially the same output voltage during normal operation. The relationship between the first and second pre-determined positions may be such that the voltage generated by the signal detector when the detachable adapter is attached to the first ignition coil at the first specified location in the first position is substantially the same when the detachable adapter is attached to the second ignition coil at the second specified location in the second position at such times as the output voltage delivered by the first ignition coil is substantially the same as the output voltage delivered by the second ignition coil.

Instructions may be printed on the probe that explain when to set the probe in the first and second positions.

A detection process may include adjusting the adjustable connector to cause the signal detector to be oriented in the first pre-determined position, attaching the detachable adapter to the housing of the first ignition coil at a first predetermined location, detaching the detachable adapter from the housing of the first ignition coil, attaching the detachable adapter to the housing of the second ignition coil at a second predetermined location; and adjusting the adjustable connector to cause the signal detector to be oriented in the second pre-determined position.

The detection process may further include examining the signal detected by the signal detector while the detachable adapter is attached to the housing of the first ignition coil and the adjustable connector is in the first position, and examining the signal detected by the signal detector while the detachable adapter is attached to the housing of the second ignition coil and the adjustable connector is in the second position.

The adjusting to cause the signal detector to be oriented in the first pre-determined position may be performed before or after attaching the detachable adapter to the first ignition coil. Similarly, the adjusting to cause the signal detector to be oriented in the second pre-determined position may be performed before or after attaching the detachable adapter to the second ignition coil.

A diagnostic system may be provided that detects and reports on the field that is emitted by an ignition coil in a housing. The diagnostic system may include a probe of the type discussed above, a signal processor in communication with the probe for processing the signal generated by the probe, and a reporting system in communication with the signal processor for reporting on the signal generated by the probe.

The probe may include an attenuator for attenuating the signal generated by the signal detector. The attenuator may be settable to a first or second position. Setting the attenuator in the first position may cause the attenuated signal generated by the signal detector when the detachable adapter is attached to the first ignition coil at the first specified location to be substantially the same as when the detachable adapter is attached to the second ignition coil at the second specified location when the attenuator is in the second position. This may be at such times as the voltage delivered by the first ignition coil is substantially the same as the voltage delivered by the second ignition coil.

The signal detector may include two parallel and electrically insulated conductive plates. One plate may be connected to a signal wire and the other plate may be connected to a ground wire. Both plates may be configured and located such that the plate connected to the ground wire significantly shields the plate that is connected to the signal wire from interference generated by sources other than the ignition coil when the detachable adapter is attached to the housing of the ignition coil. The plate connected to the signal wire may be located on the probe such that it is closer to the ignition coil when the detachable adapter is attached to the housing of the coil than the second plate.

These as well as still further features, benefits and advantages will now become clear from a review of the following Detailed Description of the Illustrative Embodiments, taken in conjunction with the drawings and claims.

BRIEF DESCRIPTION OF DRAWINGS

FIG. 1(*b*) is a rear perspective view of the probe and COP shown in FIG. 1(*a*).

FIG. 2(*a*) is a perspective view of the embodiment of the probe shown in FIG.1(*a*) attached to a Nissan Model 22448-31 U01 COP with the signal detector of the probe in a second position.

FIG. 2(*b*) is a rear perspective view of the probe and COP shown in FIG. 2(*a*).

FIG. 6(*a*) illustrates a probe for detecting a field from an ignition coil that contains a signal detector in a first position.

FIG. 6(*b*) illustrates the probe of FIG. 6(*a*) with the signal detector in a second position, laterally disposed from the first position.

FIG. 7 illustrates a diagnostic system for detecting and reporting on the field that is emitted by an ignition coil.

DETAILED DESCRIPTION OF ILLUSTRATIVE EMBODIMENTS

Figure 1A:
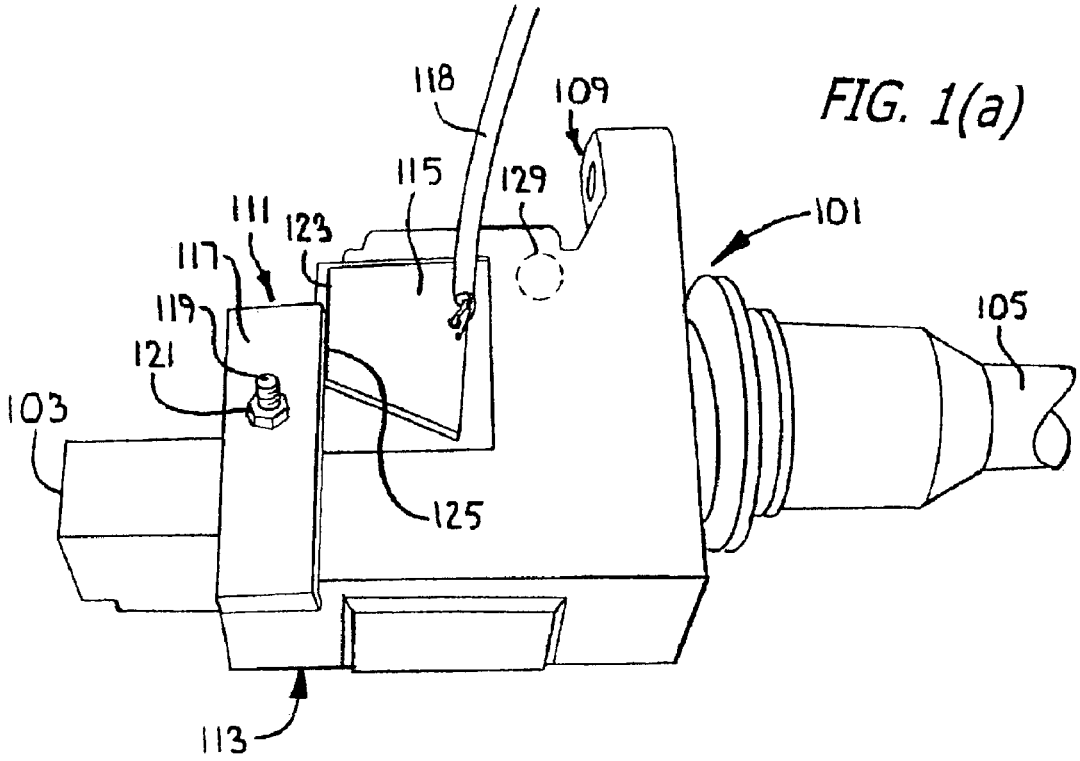
FIG. 1(*a*) is a perspective view of a probe for detecting a field that is attached to a Nissan Model 22448-2Y000 COP with the signal detector of the probe in a first position.
Figure 1B:
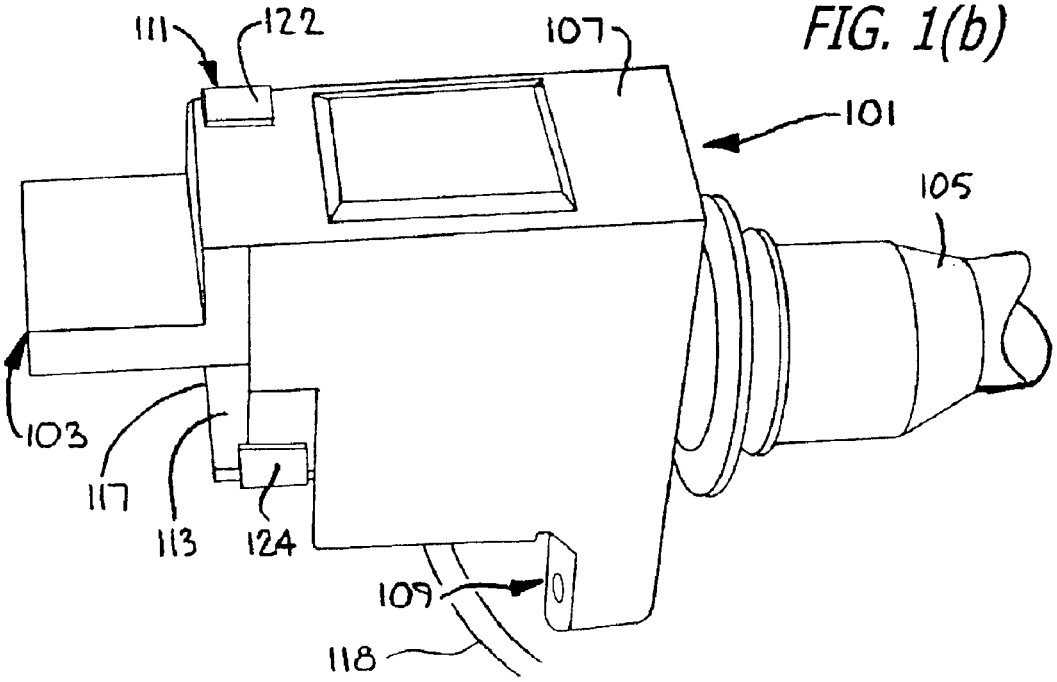

FIG. 1(*a*) is a perspective view of a probe for detecting a field attached to a Nissan Model 22448-2Y000 COP. FIG. 1(*b*) is a rear perspective view of the probe and COP shown in FIG. 1(*a*).

As shown in FIGS. 1(*a*) and 1(*b*), a COP 101 may include an input connector 103 into which a low input voltage is delivered. This is typically 12 volts, although different voltages levels may also be used.

The input connector 103 is sometimes configured to also receive a control signal, separate from the low input voltage. In these situations, an electronic switch (not shown) inside the COP 101 acts to deliver the low input voltage to the ignition coil when so instructed by the control signal.

In some embodiments, there is no control signal. Rather, the power signal is controlled externally and only delivered to the COP 101 when firing of the spark plug that is connected to it is desired.

The COP 101 may include an output wire 105 that is typically connected to a spark plug (not shown) that is being driven by the COP 101.

The COP 101 may also include an ignition coil (not visible) housed in a housing 107. The ignition coil typically consists of a primary winding that is connected to the low voltage input and a secondary coil that is electrically connected to the spark plug through the output wire 105. As is well known, the number of turns in the secondary winding are usually many multiples of the number of turns in the primary winding to facilitate the voltage boost function of the ignition coil.

As is well known and should be apparent, the housing 107 can have a broad variety of shapes and configurations. As is also well known, the housing 107 is typically secured to the engine by inserting the output wire 105 into the spark plug cylinder and by tightening a bolt (not shown) that is channeled through a connecting flange 109 into the engine.

A probe 111 is shown in FIGS. 1(*a*) and 1(*b*) as being clipped onto a specific location on the COP, such as a neck 113 of the housing 107. The probe may include a signal detector 115 and a detachable adapter, which in this instance is a clip 117. The probe 111 may also include an adjustable connector that adjustably connects the signal detector 115 to the detachable adapter 117. In this instance, the adjustable connector includes a pivot, such as a threaded screw 119 and mating nut 121. These may be used to secure a lip of the signal detector 115 (not visible) to the underside of the clip 117.

One purpose of the signal detector 115 may be to detect the field that is generated by the ignition coil, primarily the secondary winding of the ignition coil. The field may be what is known as a near electrostatic reactive field which, in most cases, is an induction field. The signal detector 115 may convert this field into an electric signal that is delivered to analysis equipment (not shown in FIGS. 1(*a*) or 1(*b*)) over an output cable 118.

In order to accomplish this result, the signal detector 115 may be placed in close proximity to the housing for the ignition coil, as illustrated in FIG. 1(*a*).

The design may ensure that the magnitude of the signal generated by the signal detector 115 does not vary when used to detect fields of the same intensity that are generated at different times by the COP 101. To accomplish this, the design may cause the relative position between the signal detector 115 and the housing 107 to be essentially the same each time the detachable adapter 117 is attached to the housing 107.

There are a broad variety of ways to accomplish this result. In the embodiment shown in FIGS. 1(*a*) and 1(*b*), this is in part accomplished by shaping the clip 117 to closely conform to the shape of the neck 113, by including locking flanges 122 and 124 as part of the clip 117 that mate, engage and clip to the neck 113 and by making the clip 117 out of strong and springy material. These design features may help ensure that the clip 117 is always clipped to the neck 113 at substantially the same location, each time it is attached.

The configuration of the adjustable connector that connects the signal detector 115 to the clip 117 can also be material to ensuring repeatability in the positioning of the signal detector 115 relative to the ignition coil. In the embodiment shown in FIG. 1(*a*), this configuration includes a surface area, such as edge 123 on the signal detector 115, that is configured to engage a corresponding surface area, such as edge 125 on the clip 117, when the signal detector 115 is positioned in the upward position with respect to the clip 117, as illustrated in FIG. 1(*a*). These abutting surfaces stop the rotational movement of the signal detector 115 and assist to releasably lock it in the first pre-determined position when rotated to the position shown in FIG. 1(*a*).

Although threaded screw 119 and nut 121 are functioning as the pivot for the signal detector in the embodiment shown in FIG. 1(*a*), it is, of course, to be understood that other types of pivots could be used, such as a rivet or pin.

It is also to be understood that there could be substantial variation in the shape and composition of the detachable adapter, as well as the location on the housing 107 to which it attaches.

FIG. 2(*a*) is a perspective view of the embodiment of the probe shown in FIG. 1(*a*) attached to a Nissan Model 22448-31U01 COP, with the signal detector of the probe in a second position. FIG. 2(*b*) is a rear perspective view of the probe and COP shown in FIG. 2(*a*).

As shown in FIGS. 2(*a*) and 2(*b*), a COP 201 may include an input connector 203 for connection to a low input voltage and, in certain embodiments, a control signal, an output wire 205 for connection to a spark plug, a housing 207 that houses an ignition coil having a primary winding connected to the low input voltage and a secondary winding connected to the output wire 205.

The same probe 111 that was shown in FIGS. 1(*a*) and 1(*b*) is also shown in FIGS. 2(*a*) and 2(*b*) as being similarly snapped onto a neck 213 of the COP 201. In FIG. 2(*a*), however, the signal detector 115 is shown as being in a second pre-determined position with respect to the clip 117. As should be apparent, this is accomplished by rotating the signal detector 115 downwardly until a surface, such as edge 223 on the signal detector 115, engages a corresponding surface, such as an edge 225 on the clip 117. As with the engaging edges 123 and 125 shown in FIG. 1(*a*), the engaging edges 223 and 225 provide a movement stop that causes the signal detector 115 to releasably lock into the second position.

The relationship between the first and second positions for the signal detector with respect to the detachable adapter can be very important to minimizing the differences in the field that is detected for the COP 101 in FIG. 1(*a*) and the COP 201 in FIG. 2(*a*). More specifically, the voltage generated by the signal detector 115 when connected to the COP 101 and positioned upwardly as shown in FIG. 1(*a*) should in certain embodiments be approximately the same as when it is connected to the COP 201 and positioned in the lower position that is shown in FIG. 2(*a*), when COP 101 is generating approximately the same output voltage as COP 201. This should occur notwithstanding differences at this time in their emitted fields.

To accomplish this result, the first and second positions for the sensor 115 are selected to cause the sensor 115 to be at different distances from the maximum field strength of the field that is emitted from COP 101 as compared to COP 201. This point of maximum field strength for COP 101 is shown in FIG. 1(*a*) to be at a location 129 and in FIG. 2(*a*) to be at a location 229. As shown in FIG. 1(*a*), the location 129 of maximum field strength is fairly close to the upward position in which the signal detector 115 has been placed. On the other hand, the COP 201 emits a stronger field. Thus, the downward position of the signal detector 115 in FIG. 2(*a*) is configured such that the signal detector 115 is further away from the location 229 of the maximum strength of the electric field that is generated by the COP 201. Ideally, and as indicated above, the relative positions may be such that the signal detector 115 generates the same signal for the same voltage outputs of the two COPs, notwithstanding differences in the fields that they emit.

As should be apparent, the optimal positions can be determined empirically through experimentation. Alternatively, or in addition, the optimal positions can be determined by relying upon the known fact that the strength of the signal generated by the signal detector 115 will vary in approximately inverse proportion to the separation distance between the signal detector and the maximum field strength to the fourth power. This can mathematically be stated by the following equation, where S is the strength of the signal generated by the signal detector, D is the distance between the signal detector and the point of maximum radiation from an ignition coil, and k is a constant:

$$S \cong \frac{k}{D^n} \text{ where } n > 2$$

With respect to the two specific models of COPs and the configuration and attached locations of the probe 111 that are illustrated in FIGS. 1(*a*) and 2(*a*), applicant has found that a rotational variation of approximately 70 degrees is optimum.

As should be apparent from an examination of the clip 111 in FIGS. 1(*a*), 1(*b*), 2(*a*) and 2(*b*), the same clip 111 is used to repeatably engage the two different COPs that are shown in these respective figures at the same pre-determined locations. Of course, the clip 117 may be designed to accomplish this result. In some situations, however, the configuration of the clip itself may need to be altered to repeatably engage the differing COPs in the same positions each time.

Although not shown, it is to be understood that instructions could be written on a portion of the probe 111, such as on a label affixed to the clip 117 or to the signal detector 115. The instructions might instruct the user as to the correct positioning of the signal detector 115 with respect to the clip 111. For example, this label might include an arrow pointing upwardly next to the words "Rear Cylinder" and another arrow pointing downwardly next to the words "Front Cylinder." Other forms of these instructions could alternatively be used.

Figure 3:
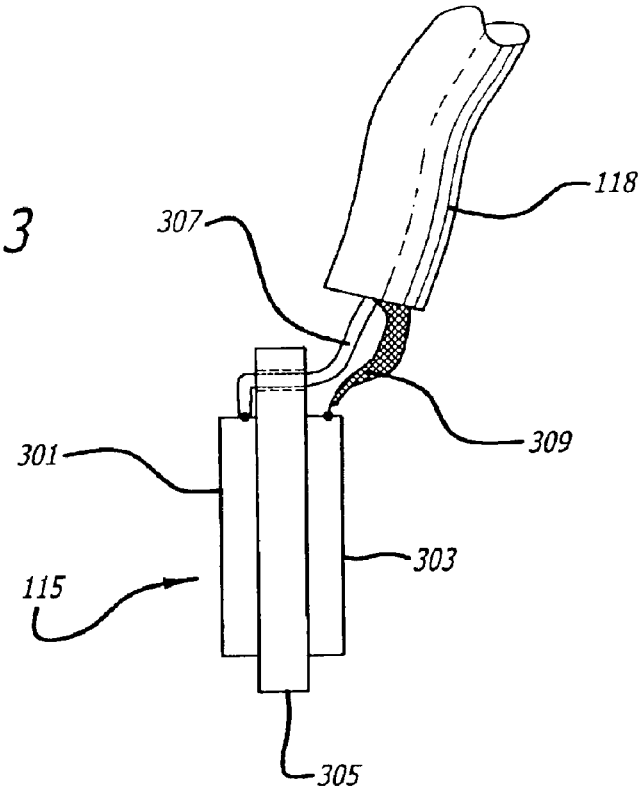
FIG. 3 illustrates a side view of the signal detector that is shown in FIGS. 1(*a*), 1(*b*), 2(*a*) and 2(*b*).

FIG. 3 illustrates a side view of the signal detector 115 that is shown in FIGS. 1(*a*) and 2(*a*). As shown in FIG. 3, the signal detector 115 includes a first conducting plate 301 separated from a second conducting plate 303 by an insulator, such as circuit board 305 on which the conducting plates are deposited. Conducting plate 301 may be electrically connected to a signal wire 307 that forms part of the output cable 118. The conducting plate 303 may be connected to a braided ground shield 309 that forms part of the output cable 118. Of course, unshielded cables could also be used.

The signal detector 115 may be connected to the clip 117 such that the conducting plate 303 that is connected to the ground shield 309 is on the outside of the signal detector and furthest away from the ignition coil after the detachable adapter is attached to the housing of the ignition coil. This would leave the conducting plate 301 that is connected to the signal wire sandwiched between the two. In this embodiment, the conducting plate 303 that is connected to the ground wire serves to protect the conducting plate 301 that is connected to the signal wire from fields that are extraneous to the ignition coil, i.e., fields that not generated by the ignition coil. In the absence of this ground plate, the signal detector 115 might be more susceptible to noise and other extraneous interference, possibly reducing the signal-to-noise ratio of the detector and thus its suitability to COPs that generate fields of low intensity.

To be sure, the use of a shield plate connected to ground is not required. Even a single plate connected to the signal wire will work.

The single plate that is connected to the signal wire, whether or not protected by a secondary plate connected to a ground wire, is believed to form a capacitor with the windings of the ignition coil, causing variations in the field between these two objects to generate an electric signal.

Figure 4:
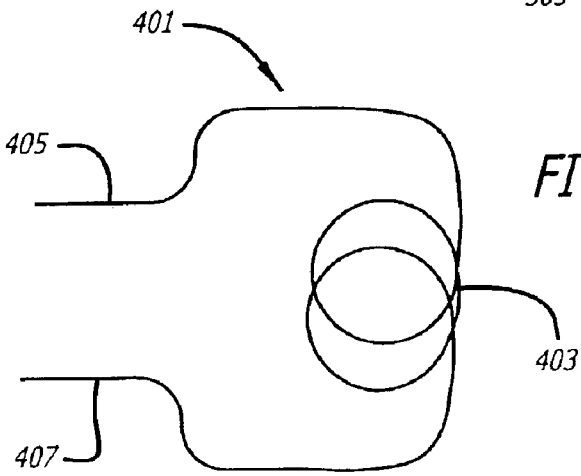
FIG. 4 illustrates a signal detector using a coil.

FIG. 4 illustrates a signal detector 401 using a coil of wire 403 instead. Unlike the embodiment of the signal detector 115 shown in FIG. 3, the signal detector 401 that is shown in FIG. 4 utilizes inductive coupling to the field as a detection technique. The coil could be connected to the an output cable through connecting wires 405 and 407.

Figure 5:
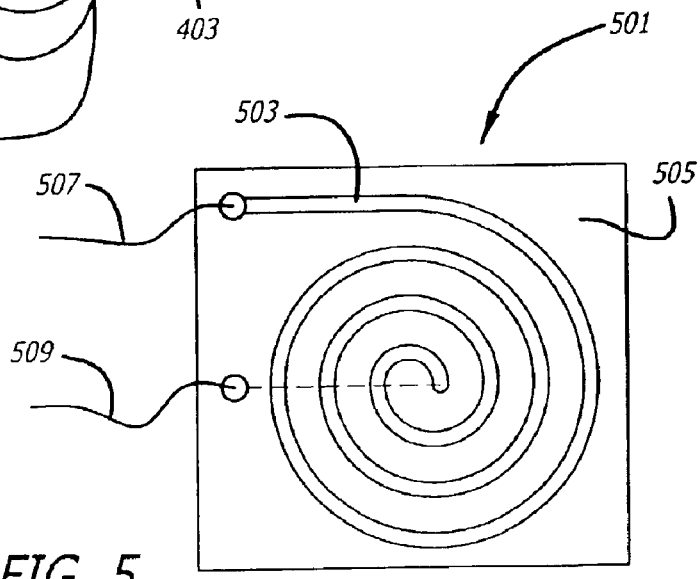
FIG. 5 illustrates a signal detector using a coil etched on a circuit board.

FIG. 5 illustrates a signal detector using a coil etched on a circuit board. As shown in FIG. 5, a signal detector 501 includes foil 503 etched in a spiral pattern on a circuit board 505. Connections 507 and 509 to the coil can be made in accordance with well-known techniques. The coil can also take the form of a circuit element such as a wound inductor employing a magnetic or air core.

The coil shown in FIG. 5 is one embodiment of the coil shown in FIG. 4. Of course, it is to be understood that the coils shown in FIG. 4 or FIG. 5 would be part of the signal detector that, like the embodiments shown in FIGS. 1–3, is adjustably connected to a detachable adapter so that the signal detector can be placed in a first predetermined position or a second predetermined position with respect to the detachable adapter. The other aspects of the probe and the associated COPs might be the same as were discussed above in connection with the capacitive embodiment shown in FIGS. 1–3.

FIG. 6(*a*) illustrates a probe for detecting a field from an ignition coil that contains a signal detector in a first position. FIG. 6(*b*) illustrates the same probe with the signal detector in a second position, laterally disposed from the first position. As shown in FIG. 6(*a*), a probe 601 includes a detachable adapter, such as a clip 603. Adjustably connected to the clip 603 through an adjusting adapter is a signal detector 605. Attached to the signal detector 605 is an output cable 607.

The clip 603, signal detector 605 and output cable 607 may be governed by the same considerations and have the same variations as were discussed above in connection with FIGS. 1–5. Unlike the adjustable connector that included a pivot and that was shown in FIGS. 1(*a*) and 2(*a*), however, the adjustable connector that is illustrated in FIGS. 6(*a*) and 6(*b*) allows the signal detector 605 to move from the first to second positions with respect to the clip 603 laterally, rather than rotationally. This is facilitated by the inclusion of a slot 609 in the signal detector that allows the signal detector 605 to slide laterally with respect to the clip 603. A fastening member 611, such as a rivet, pin or nut and bolt (not shown), may ensure that the signal detector 605 remains engaged to the clip 603 both during and after the sliding movement. Downward protrusions 613 and 615 in the signal detector 605 may alternately engage a mating opening 617 in the clip 603, the lower protrusion 613 engaging the opening 617 when the signal detector 605 is slid to its upward position, while the upward protrusion 615 engaging the opening 617 when the signal detector 605 is slid to its lower position. These constitute movement stops that cause the signal detector 605 to releasably lock into the first and second positions.

For optimal performance, the first and second positions of the signal detector 605 that are shown in FIGS. 6(*a*) and 6(*b*), respectively may be the same as the first and second positions of the signal detector 115 that is shown in FIGS. 1(*a*) and 2(*a*), respectively. The only difference is that the signal detector 605 moves laterally between positions, while the signal detector 115 moves rotationally between the positions. If signal detector 605 is the same as signal detector 115 in FIG. 1(*a*), a positional displacement of approximately 0.38 inches for the types of COPs shown in FIGS. 1(*a*) and 1(*b*) may be optimum. Of course, variations in the size or composition of the signal detector 605 may justify corresponding variations in the first and second positions.

FIG. 7 illustrates a diagnostic system for detecting and reporting on the field that is emitted by an ignition coil. As shown in FIG. 7, a probe 701, such as one of the probes described above, may be connected to a signal processor 703 which, in turn, may be connected to a reporting system 705.

The raw signal that comes from the probe 701 may be processed by the signal processor 703 to extract or to emphasize the most common types of needed information. For example, the signal processor 703 could analyze the signal from the probe 701 for determining the burn time of the spark plug, i.e., the length of the period during which the spark is ignited. The signal processor 703 could similarly analyze the signal from the probe 701 to determine the firing line, i.e., the voltage that is reached immediately before the spark plug fires. The signal processor 703 could also be used to analyze the signal from the probe 701 to determine the spark line, i.e., the voltage across the spark plug while the spark is burning.

The output of these determinations could be delivered to the reporting system 705. The reporting system 705 could include a trace scope that simply shows the signal that emanates from the probe 701, possibly amplified and filtered by the signal processor 703. Reporting system 705 could instead or in addition provide numerical values for some or all of the important parameters, such as burn time, firing line and spark line. Further details on how such an analysis could be performed and how the subsystems might cooperate is set forth in U.S. Pat. No. 6,396,277 B1, the content of which is incorporated herein by reference. A Vantage® handheld electronic diagnostic device commercially available from Snap-On Diagnostics in San Jose, Calif., might also be used.

Although the probe is shown as being connected to the signal processor, and although the signal processor is shown as being connected to the reporting system, it should be understood that either or both of these connections could be wired connections or wireless connections.

The operation and use of the apparatus illustrated in FIG. 7 should now be apparent. By way of illustration only, a mechanic might attach the probe 701 to the first housing for an ignition coil feeding a front cylinder of an engine. Either before or after attaching the probe 701, the mechanic might set the signal detector to its upper predetermined position. The mechanic would then run the engine and study the report provided by the reporting system 705.

The mechanic might then remove the probe 701 from the first housing and attach it to a second housing for an ignition coil feeding another cylinder of the engine. If the cylinder is on the same side of the engine, no change in the position of the signal detector might be needed. On the other hand, if the cylinder is on a different side of the engine, the mechanic might move the signal detector to its lower position with respect to the detachable adapter. This could be done before or after attaching the probe to the second housing. The mechanic would again run the engine and analyze the report provided by the reporting system 705.

The mechanic might then repeat this process for one or more of the remaining cylinders. Based on the information provided by the reporting system, the mechanic might replace an ignition coil, spark plug or other component. The mechanic might instead make appropriate adjustments.

Although certain embodiments have been shown and described, it is to be understood that these are merely illustrations and examples and are not to be taken as limitations.

For example, although the probe has thus-far been described as being configured to attach to the housing of an ignition coil, it is to be understood that the probe could also be configured to attach to another object that itself is directly or indirectly attached to the housing. It is therefore to be understood that the references in this application to "housing" are intended in their broader sense to also embrace these other objects.

Similarly, although mechanical movement of the signal detector has thus-far been described as a technique for compensating for differences in field strength, these differences could instead or in addition be compensated for by signal attenuation techniques, such as by switchably attenuating the amplitude of the signal that is generated by the signal detector. One such embodiment might include a resistor or resistor network that is selectively switched into or out of the electrical connection to the signal detector, the components of which could be included as part of the signal detector or elsewhere. Appropriate means to protect the switch and electrical components from environmental damage might also be included.

It is also to be understood that the embodiments described herein may include or be utilized with any appropriate voltage source, such as a battery, an alternator or the like, providing any appropriate voltage, such as about 12 volts, about 42 volts or the like.

The clip may also be used with housings that have differences in the configuration of the necks to which the clip is adapted. In this circumstance, the clip may be provided with a configuration that facilitates its detachable attachment to both neck configurations.

The embodiments described herein may also be used with any desired system or engine. Those systems or engines may use fossil fuels, such as gasoline, natural gas, propane or the like; electricity, such as that generated by battery, magneto, solar cell or the like; or wind and hybrids or combinations thereof. Those systems or engines may be incorporated into other systems, such as an automobile, a truck, a boat or ship, a motorcycle, a generator, an airplane or the like.

In short, the coverage of this application for patent is limited solely by the claims that now follow.

I claim:

1. A probe for detecting the field emitted by an ignition coil in a housing, the probe comprising:

a) a signal detector for detecting the field;

b) a detachable adapter configured to detachably attach to the housing of the ignition coil at a specified location; and c) an adjustable connector adjustably connecting the signal detector to the detachable adapter, wherein the signal detector is movable between a first pre-determined position and a second pre-determined position.

2. The probe of claim 1 wherein the signal detector includes a conductive plate.

3. The probe of claim 2 wherein the signal detector includes two conductive plates.

4. The probe of claim 3 wherein one of the plates is connected to a ground wire and the other plate is connected to a signal wire.

5. The probe of claim 4 wherein the two plates are substantially parallel to but electrically insulated from one another.

6. The probe of claim 5 wherein the plate that is connected to the signal wire is located such that it will lie between the plate that is connected to the ground wire and the ignition coil after the adapter is attached to the housing of the ignition coil.

7. The probe of claim 1 wherein the signal detector includes a coil.

8. The probe of claim 1 wherein the detachable adapter includes a clip.

9. The probe of claim 8 wherein the clip is configured to snap onto the housing.

10. The probe of claim 1 wherein the adjustable connector includes a pivot.

11. The probe of claim 1 wherein the adjustable connector allows the signal detector to move laterally with respect to the detachable adapter when moving from the first to the second position.

12. The probe of claim 1 wherein the adjustable connector includes a first movement stop that causes the signal detector to releasably lock into the first position and a second movement stop that causes the signal detector to releasably lock into the second position.

13. The probe of claim 12 wherein the first movement stop includes two surface areas that engage when the signal detector is releasably locked into the first position.

14. The probe of claim 13 wherein the second movement stop includes two surface areas that engage when the signal detector is releasably locked into the second position.

15. A probe for detecting the field that is emitted by a first ignition coil in a housing and, at a different time, by a second ignition coil in a housing, the first and second ignition coils radiating fields of different magnitude during the delivery of substantially the same output voltage during normal operation, the probe comprising:

a) a signal detector that generates a voltage upon detection of a field;

b) a detachable adapter configured to detachably attach to the housing of the first ignition coil at a first specified location and to the housing of the second ignition coil at a second specified location;

c) an adjustable connector that adjustably connects the signal detector to the detachable adapter in a first pre-determined position or in a second pre-determined position, wherein the relationship between the first and second pre-determined positions are such that voltage generated by the signal detector when the detachable adapter is attached to the first ignition coil at the first specified location in the first position is substantially the same as the voltage generated by the probe when the detachable adapter is attached to the second ignition coil at the second specified location in the second position at such times as the output voltage delivered by the first ignition coil is substantially the same as the output voltage delivered by the second ignition coil.

16. The probe of claim 15 further including instructions printed on the probe that explain when to set the probe in the first and second positions.

17. A diagnostic system for detecting and reporting on the field that is emitted by an ignition coil in a housing, the diagnostic system comprising:

a) a probe, the probe comprising:

1) a signal detector that generates a signal that indicates the presence of a field;

2) a detachable adapter configured to detachably attach to the housing of the ignition coil at a specified location; and 3) an adjustable connector adjustably connecting the signal detector to the detachable adapter, wherein the signal detector is movable between a first pre-determined position and a second pre-determined position.

b) a signal processor in communication with the probe for processing the signal generated by the probe; and c) a reporting system in communication with the signal processor for reporting on the electric signal generated by the probe.

18. Apparatus for detecting the field that is emitted by an ignition coil in a housing, the apparatus comprising:

a) means for detecting the field;

b) means configured to detachably attach to the housing of the ignition coil at a specified location; and c) means for adjustably connecting the means for detecting to the means configured to detachably attach, wherein the means for detecting is movable between a first pre-determined position and a second pre-determined position.

19. A probe for detecting the field that is emitted by a first ignition coil in a housing and, at a different time, by a second ignition coil in a housing, the first and second ignition coils radiating fields of different magnitude during the delivery of substantially the same output voltage during normal operation, the probe comprising:

a) a signal detector that generates a voltage upon detection of a field;

b) a detachable adapter configured to detachably attach to the housing of the first ignition coil at a first specified location and to the housing of the second ignition coil at a second specified location;

c) a adapter that connects the signal detector to the detachable adapter; and d) an attenuator for attenuating the signal generated by the signal detector, the attenuator being settable to a first or second position, whereby the attenuated signal generated by the signal detector is substantially the same under either of the following circumstances:

e) the attenuator is set in the first position, the detachable adapter is attached to the first ignition coil at the first specified location, and the voltage delivered by the first ignition coil is a first voltage; and f) the attenuator is set in the second position, the detachable adapter is attached to the second ignition coil in the second specified location, and the voltage delivered by the second ignition coil is substantially the same as the first voltage.

* * * * *